US009035855B2

(12) United States Patent
Tanada

(10) Patent No.: US 9,035,855 B2
(45) Date of Patent: May 19, 2015

(54) DISPLAY DEVICE AND DRIVING METHOD THEREOF

(75) Inventor: Yoshifumi Tanada, Kanagawa (JP)

(73) Assignee: SEMICONDUCTOR ENERGY LABORATORY CO., LTD. (JP)

( * ) Notice: Subject to any disclaimer, the term of this patent is extended or adjusted under 35 U.S.C. 154(b) by 623 days.

(21) Appl. No.: 10/885,808

(22) Filed: Jul. 7, 2004

(65) Prior Publication Data

US 2005/0219164 A1 Oct. 6, 2005

(30) Foreign Application Priority Data

Jul. 8, 2003 (JP) ..... 2003-272021

(51) Int. Cl.
*G09G 3/32* (2006.01)
*G09G 3/30* (2006.01)

(52) U.S. Cl.
CPC ..... *G09G 3/30* (2013.01); *G09G 2300/0809* (2013.01); *G09G 2320/0233* (2013.01)

(58) Field of Classification Search
CPC ..... H01L 27/3248; G09G 3/3233
USPC ..... 315/169.1–169.4; 345/76–83
See application file for complete search history.

(56) References Cited

U.S. PATENT DOCUMENTS

| | | | | |
|---|---|---|---|---|
| 5,247,190 | A | 9/1993 | Friend et al. | |
| 5,399,502 | A | 3/1995 | Friend et al. | |
| 5,440,208 | A | 8/1995 | Uskali et al. | |
| 5,670,792 | A | 9/1997 | Utsugi et al. | |
| 5,748,165 | A | 5/1998 | Kubota et al. | |
| 5,965,363 | A | 10/1999 | Monforte et al. | |
| 6,421,034 | B1 | 7/2002 | Mihara | |
| 6,433,485 | B2 * | 8/2002 | Tai et al. | 315/169.2 |
| 6,476,419 | B1 | 11/2002 | Yasuda | |
| 6,512,504 | B1 | 1/2003 | Yamauchi et al. | |
| 6,528,950 | B2 * | 3/2003 | Kimura | 315/169.3 |
| 6,529,178 | B1 | 3/2003 | Kimura | |
| 6,556,177 | B1 | 4/2003 | Katayama et al. | |
| 6,559,594 | B2 | 5/2003 | Fukunaga et al. | |
| 6,580,408 | B1 | 6/2003 | Bae et al. | |
| 6,580,409 | B1 * | 6/2003 | Ito et al. | 345/76 |
| 6,583,576 | B2 * | 6/2003 | Koyama | 315/169.2 |

(Continued)

FOREIGN PATENT DOCUMENTS

| | | |
|---|---|---|
| EP | 1 103 946 A2 | 5/2001 |
| EP | 1 176 457 A2 | 1/2002 |

(Continued)

OTHER PUBLICATIONS

Office Action re Korean application No. KR 10-2006-7000370, dated Jan. 17, 2011 (with English translation).

(Continued)

*Primary Examiner* — Quan-Zhen Wang
*Assistant Examiner* — Calvin C Ma
(74) *Attorney, Agent, or Firm* — Husch Blackwell LLP

(57) ABSTRACT

In an active matrix display device, luminance distribution due to a voltage drop in a pixel portion is reduced, thereby obtaining a uniform display. In a display device having multiple current supply paths provided around the pixel portion, a current is supplied to the pixel portion using a current supply path selected among the multiple current supply paths, and the selected current supply path is switched with the passage of time to average the voltage distribution with time.

8 Claims, 5 Drawing Sheets

(56) References Cited

U.S. PATENT DOCUMENTS

| | | | | |
|---|---|---|---|---|
| 6,633,270 | B2 | 10/2003 | Hashimoto | 345/76 |
| 6,661,397 | B2 * | 12/2003 | Mikami et al. | 345/76 |
| 6,690,117 | B2 * | 2/2004 | Komiya | 315/169.3 |
| 6,714,178 | B2 | 3/2004 | Koyama et al. | |
| 6,777,885 | B2 | 8/2004 | Koyama | |
| 6,864,638 | B2 | 3/2005 | Ishihara et al. | |
| 6,943,500 | B2 * | 9/2005 | LeChevalier | 315/169.3 |
| 6,947,019 | B2 * | 9/2005 | Sato et al. | 345/82 |
| 7,046,220 | B2 * | 5/2006 | Tagawa et al. | 345/76 |
| 7,164,155 | B2 | 1/2007 | Yamazaki et al. | |
| 7,233,322 | B2 | 6/2007 | Takehara et al. | |
| 7,372,437 | B2 | 5/2008 | Koyama | |
| 7,557,779 | B2 | 7/2009 | Tanada | |
| 2001/0043168 | A1 | 11/2001 | Koyama et al. | |
| 2002/0011796 | A1 * | 1/2002 | Koyama | 315/169.1 |
| 2002/0011975 | A1 | 1/2002 | Yamazaki et al. | 345/76 |
| 2002/0011976 | A1 | 1/2002 | Hashimoto | 345/76 |
| 2003/0071563 | A1 | 4/2003 | Hamada et al. | 313/500 |
| 2003/0071576 | A1 | 4/2003 | Koyama | |
| 2003/0090446 | A1 * | 5/2003 | Tagawa et al. | 345/76 |
| 2003/0090447 | A1 * | 5/2003 | Kimura | 345/82 |
| 2003/0137253 | A1 | 7/2003 | Kimura | |
| 2004/0000865 | A1 | 1/2004 | Yamazaki | |
| 2004/0135175 | A1 * | 7/2004 | Kurokawa | 257/207 |
| 2004/0233125 | A1 * | 11/2004 | Tanghe et al. | 345/1.3 |
| 2005/0156509 | A1 | 7/2005 | Yamazaki et al. | |
| 2009/0262050 | A1 | 10/2009 | Tanada | |

FOREIGN PATENT DOCUMENTS

| | | | |
|---|---|---|---|
| JP | 8-137443 | | 5/1996 |
| JP | 2000-148096 | | 5/2000 |
| JP | 2000-242196 | | 9/2000 |
| JP | 2001-343933 | | 12/2001 |
| JP | 2002-040961 | A | 2/2002 |
| JP | 2002-108252 | | 4/2002 |
| JP | 2002-110343 | A | 4/2002 |
| JP | 2003-66903 | | 3/2003 |
| JP | 2003-108030 | A | 4/2003 |
| JP | 2003-150107 | A | 5/2003 |
| JP | 2003-177680 | A | 6/2003 |
| JP | 2003-228333 | | 8/2003 |
| JP | 2004-138946 | | 5/2004 |
| WO | WO 90/13148 | A1 | 11/1990 |

OTHER PUBLICATIONS

International Search Report re application No. PCT/JP2004/009176, dated Sep. 21, 2004 (In Japanese).

Written Opinion re application No. PCT/JP2004/009176, dated Sep. 21, 2004 (with partial English translation).

* cited by examiner

〈i〉

〈ii〉

〈iii〉

DISPLAY DEVICE AND DRIVING METHOD THEREOF

TECHNICAL FIELD

The present invention relates to a display device of which multiple pixels arranged in matrix are used to display images, and a driving method thereof.

BACKGROUND OF THE INVENTION

In recent years, display devices such as a liquid crystal display (LCD) and an electroluminescence (EL) display are advancing in their enlargement of display screens and higher resolution as well as the higher integration of circuits by integrally forming a pixel portion and a peripheral circuit for controlling the pixel portion over a substrate.

An electroluminescence (EL) element is an element for obtaining light emission by a current flow therethrough. A display device fabricated by using the element has the advantage of wide viewing angle and high luminance since it is of a self-luminous type, which is therefore expected to be used for display devices of the next-generation.

In addition, as for an active matrix display device that integrates a pixel portion and a peripheral driver circuit over a substrate, a larger display screen and higher resolution can be obtained as opposed to a passive matrix display device, thus is supposed to be the mainstream in future.

FIG. 4A illustrates a basic structure of an active matrix EL display device. A pixel portion 402 is provided over a substrate 401. A source signal line driver circuit 403 and a gate signal line driver circuit 404 are provided around the pixel portion 402. Signal input to the source signal line driver circuit 403 and the gate signal line driver circuit 404, a current supply to EL elements and the like are carried out through a flexible print circuit (FPC) 405 from outside.

The pixel portion 402 comprises multiple pixels 411 arranged in matrix as shown in FIG. 4B, each of which light emission state is controlled to display images. Each of the pixels comprises a switching TFT 415 and a driving TFT 416, and controlled by signals from a source signal line 412 and a gate signal line 413. When the switching TFT 415 is turned ON and a video signal is inputted to the gate electrode of the driving TFT 416, a current accordingly is supplied from a current supply line 414 to an EL element 417 through the driving TFT 416, whereby light emission is obtained.

In the active matrix EL display device, luminance thereof varies according to the current value supplied to an EL element. There is a method for utilizing this for expressing gray scales, however, since TFTs are likely to have variations in the threshold values or mobility on the display screen in manufacture, there may be a case where luminance variations are caused on the display screen even with the same gray scale signal. Hereupon, there is known a digital time gray scale method by which a driving TFT is controlled to be only in two states of ON/OFF, and a gray scale is expressed by controlling the time for supplying a current to an EL element. The digital time gray scale method is described in detail in Japanese Patent Laid-Open No. 2001-343933.

In general, a current to the EL element 417 included in each pixel is supplied from outside through the FPC to a wiring provided around the display region, and then through each current supply line to each pixel as shown by an arrow in FIG. 4B. The current supply path is not necessarily like the one shown in FIG. 4B, however, the current supply path desirably has as large number of input sources as possible in general in consideration of the wiring resistance or the like.

When having a current path as shown in FIG. 4B, current is ideally supplied to the pixel portion uniformly from the current supply lines that are led out to both the upper side and the lower side. However, in practice, the amount of current flowing through a path A that is closer to the FPC is far larger than the amount of current flowing through a path B, which causes a gradient on the display screen downwardly and further from the left and right edges toward the center due to a voltage drop. When it is shown schematically, the gradient as shown in FIG. 5A is caused. The voltage drop caused on the lower side is particularly large although there is a current supply path provided by the lead wiring on the periphery.

FIG. 5B illustrates a schematic configuration diagram of a pixel 500 comprising a driving TFT, an EL element and a current supply line. As an example, a driving TFT 502 is assumed to be a P-channel TFT. Luminance control of the EL element is determined by the gate-source voltage VGS and the source-drain voltage VDS of the driving TFT 502 as shown in FIG. 5B. That is, in the graphs shown in FIG. 5C, a point A represents an operating point, and the voltage between the potential $V_{ANODE}$ of the current supply line and the potential $V_{CATHODE}$ of a counter electrode is divided by the VDS of the driving TFT 502 and the Anode-Cathode voltage VEL of the EL element.

Whether the driving TFT 502 operates in a saturation region or a linear region determines each of the driving conditions.

As shown in FIG. 5C <i>, when the operating point is determined so that the driving TFT 502 operates in a saturation region, change in the current value in the operating point is small even when the EL element 503 degrades and the V-I characteristics thereof change from the solid line to the dotted line, thus change in luminance is also small. That is, a margin can be secured for the degradation of the EL element 503. Further, even when the margin causes a voltage drop on the counter electrode 504 side to a certain level, the current value does not change specifically until the transition of the operating region of the driving TFT 502 from a saturation region to a linear region. Therefore, change in luminance can be suppressed. On the other hand, since the VDS of the driving TFT 502 is increased, the drive voltage (Anode-Cathode voltage) as a whole is increased correspondingly, leading to the adversely increased power consumption.

Meanwhile, as shown in FIG. 5C <ii>, when the operating point is determined so that the driving TFT 502 operates in a linear region, the VDS of the driving TFT 502 becomes far smaller, thus the drive voltage (Anode-Cathode voltage) as a whole can be suppressed. Further, slight change in the VGS of the driving TFT 502 does not affect the image quality easily. However, as the former, the degradation of the EL element 503 directly affects the change in luminance.

Now the case is considered where the aforementioned voltage drop is caused in the current supply line 501 or the counter electrode 504. A voltage drop on the current supply line 501 side affects the source potential of the driving TFT 502. That is, the source potentials of the driving TFTs 502 have variations between the upper portion and the lower portion of the display screen, leading to the variations in the VGS. Specifically, the VGS of the driving TFTs 502 in the lower portion of the display screen is smaller than that of the upper portion thereof, leading to the small current value. That is, there are the luminance variations between the upper portion and the lower portion of the display screen. This tends to appear more frequently when the driving TFT 502 operates in a saturation region.

On the other hand, when there is no change in the characteristics of the EL element 503, a voltage drop on the counter electrode 504 side affects the drain potential of the driving TFT 502. That is, the drain potentials of the driving TFTs 502 have variations between the upper portion and the lower portion of the display screen, leading to the variations in the VDS. Specifically, the VDS of the driving TFTs 502 in the lower portion of the display screen is smaller than that of the upper portion thereof, leading to the small current value. In this case also, there are the luminance variations between the upper portion and the lower portion of the display screen. This tends to appear more frequently when the driving TFT 502 operates in a linear region.

In this manner, a voltage drop on the display screen due to the wiring resistance significantly affects the display quality. Such problem tends to arise more frequently when a current value consumed on the display screen is larger. That is, the voltage drop is an unavoidable problem when taking a large display screen into account.

In view of the aforementioned problems, the invention provides a display device that can provide favorable display quality and a driving method thereof by making the voltage distribution on the display screen uniform without the need of an additional voltage compensation circuit and the like that would cause an increase in the power consumption.

Even when current paths are provided on both of the upper portion and the lower portion of the display screen, the upper path becomes dominant due to a difference between the values of the wiring resistance, which makes it impossible to obtain an ideal voltage gradient as described above.

SUMMARY OF THE INVENTION

The invention provides a structure in which the current supply path to the upper portion of the display screen is completely separated from the current supply path to the lower portion of the display screen. Further, by setting the current supply from the upper portion of the display screen and the current supply from the lower portion of the display screen to be at the different timing, voltage drop caused on the display screen is offset, thereby obtaining favorable voltage distribution on the display screen.

The structure of the invention is described below.

A display device of the invention is characterized in comprising:

a pixel portion in which multiple pixels are arranged in matrix;

multiple current supply paths provided around the pixel portion; and a switch for selecting at least one of the multiple current supply paths.

A driving method of a display device of the invention comprising:

a pixel portion in which multiple pixels are arranged in matrix;

and multiple current supply paths being provided around the pixel portion, the method characterized by comprising the steps of:

supplying a current to the pixel portion using a current supply path selected among the multiple current supply paths; and switching the selected current supply path with the passage of time.

The switching of the current supply path is desirably performed in the cycle of once or more in one frame period.

According to the invention, in an active matrix display device such as an EL display device, luminance distribution due to a voltage drop on the display screen by the wiring resistance is controlled, whereby a favorable display can be obtained. In addition, the invention is more effective in the case where the power consumed on the display screen is larger, and the invention is expected to contribute to achieve the higher resolution and enlargement of a display screen that is supposed to further advance in future.

DETAILED DESCRIPTION OF THE PRESENTLY PREFERRED EMBODIMENTS

Figure 1A:
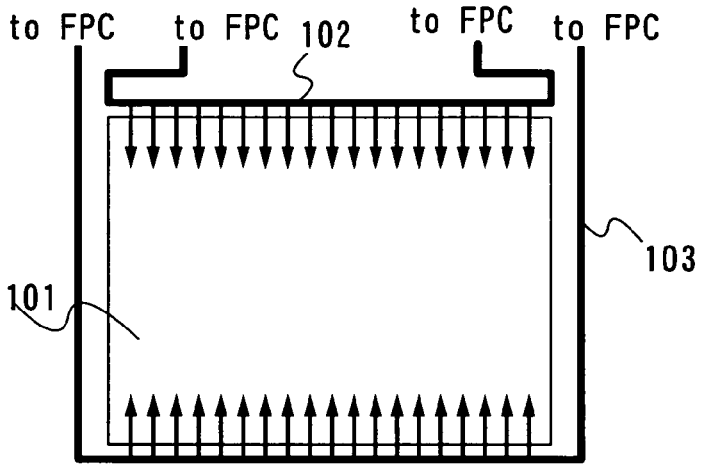
FIGS. 1A-1C illustrate diagrams showing one embodiment of the invention.
Figure 4A:
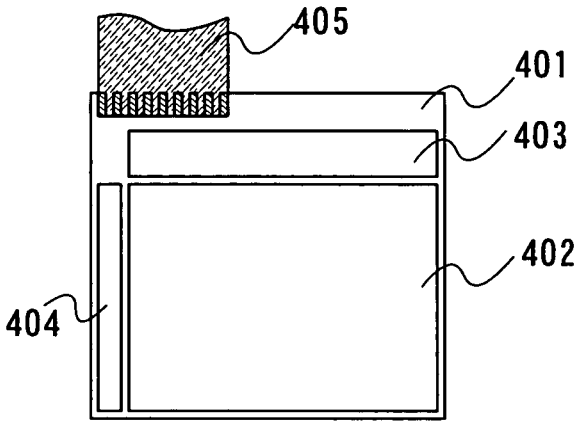
FIGS. 4A-4B illustrate diagrams showing the structure of an active matrix display device and the structure of a pixel portion.
Figure 4B:
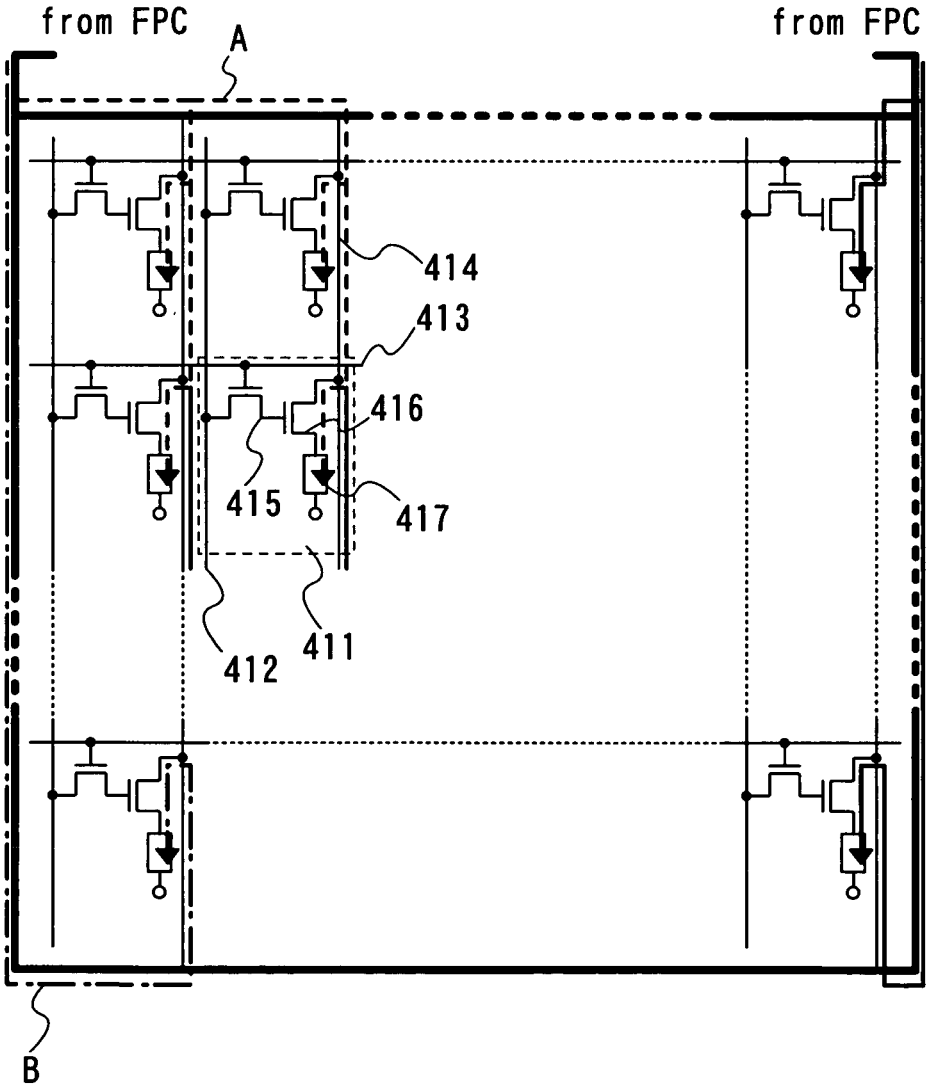
Figure 5A:
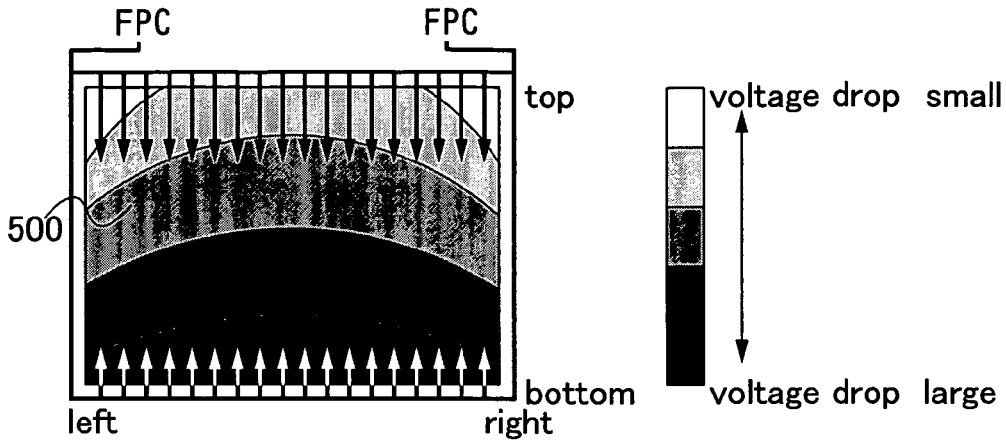
FIGS. 5A-5C illustrate diagrams showing the voltage drop in a pixel portion and the operating state of an EL element.
Figure 5B:
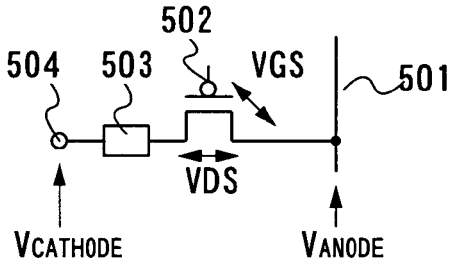
Figure 5C:
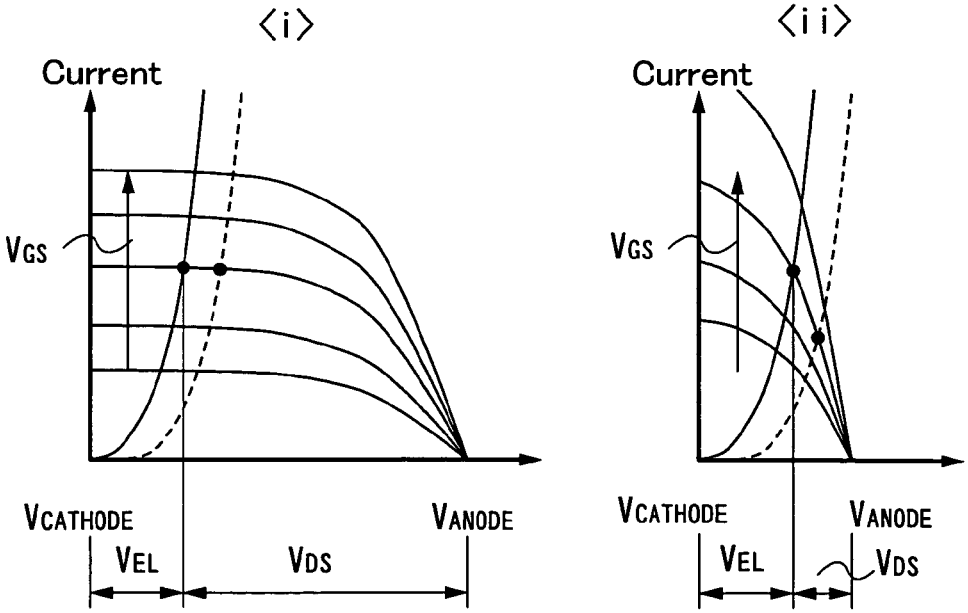

FIG. 1A illustrates an embodiment mode of the invention. It has paths to input currents from the upper side and the lower side of the pixel portion 101 as in FIG. 4B. In this embodiment, however, it is assumed that the input path from the upper side of the pixel portion 101 is a first current supply path 102, and the input path from the lower side of the pixel portion 101 is a second current supply path 103, each of which is disposed as an independent path over a substrate.

Figure 1B:
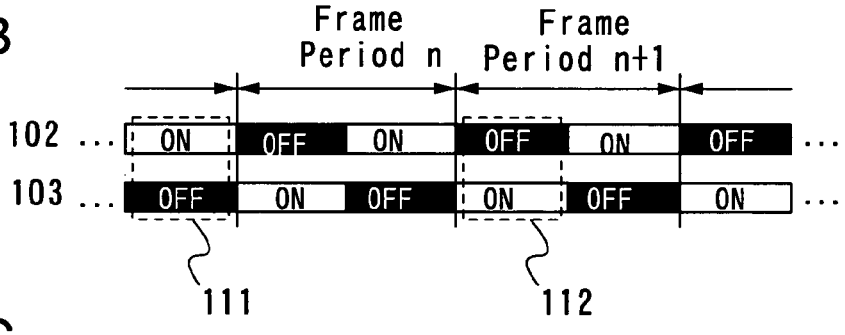

In the first current supply path 102 and the second current supply path 103, ON/OFF of the current supply is switched at least once within a frame period as shown in FIG. 1B. Within a certain frame period, in the period denoted by the dotted frame 111, a current is supplied from the first current supply path 102 while the current supply from the second current supply path 103 is blocked. Meanwhile in the period denoted by the dotted frame 112, current is supplied from the second current supply path 103 while the current supply from the first current supply path 102 is blocked.

Figure 1C:
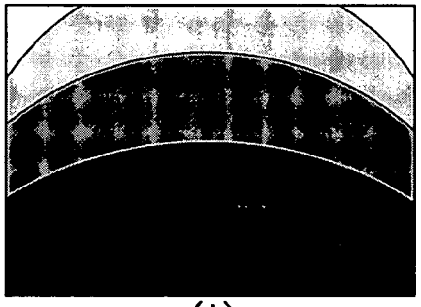
Figure 1C:
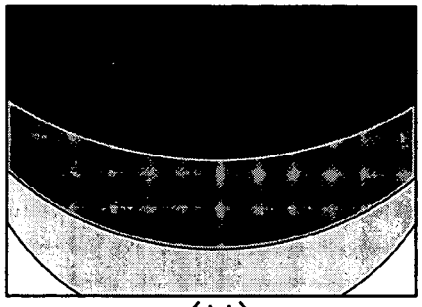
Figure 1C:
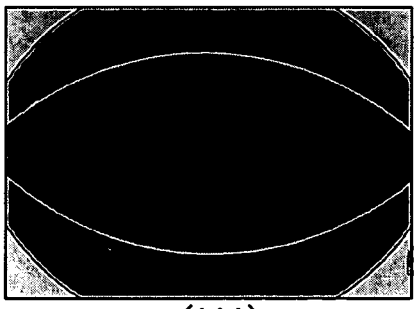

While a current is supplied from the first current supply path 102, voltage distribution in the pixel portion 101 is as shown in FIG. 1C <i>. Specifically, a voltage drop occurs in the direction from the upper right and upper left portions of the display screen that is the closest to the FPC among the current paths to the central lower end. On the other hand, while a current is supplied from the second current supply path 103, voltage distribution in the pixel portion 101 is as shown in FIG. 1C <ii>. Specifically, a voltage drop occurs in the direction from the lower right and the lower left of the display screen that is the closest to the FPC among the current paths to the central upper end. FIG. 1C <ii> shows the distribution that is the vertical inversion of FIG. 1C <i> for ease of description of the principle, however, in practice, FIG. 1C <ii> has a larger voltage drop than that of FIG. 1C <i> as a whole due to the effect of the wiring resistance of the lead portion from the FPC to the lower end of the display screen.

The aforementioned two states, that are the states shown in FIGS. 1C <i> and <ii> alternately appear within a frame period. Averaging the voltage distribution during the period that images are displayed successively renders the apparent voltage distribution in the pixel portion 101 to be like FIG. 1C <iii>. It is seen that the potential difference between the end portion and the central portion of the display screen is smaller.

As described above, with regard to the states in FIGS. 1C <i> and <ii>, the voltage drop in FIG. C <ii>, in practice, has larger distribution than the voltage drop in FIG. 1C <i> as a whole, due to the effect of the wiring resistance of the leading portion from the FPC to the lower end of the display screen. Therefore, a gradient of the voltage drop in the pixel portion 101 can be reduced as compared to the case where the voltage drop caused on the display screen is offset to be averaged simply by supplying a current from a current supply line that is led out to both of the upper side and the lower side of the pixel portion. Specifically, the voltage drop in the direction from the first current supply line 102 to the center of the pixel portion and the voltage drop in the direction from the second current supply circuit to the center of the pixel portion are different from each other, so that the voltage drop caused on the display screen can be offset more, which decreases the gradient of the voltage distribution in the pixel portion 101.

In the case where currents are constantly supplied from current supply lines on both of the upper side and lower side of the pixel portion, in the structure shown in FIG. 1A, one of the current supply lines on the upper side or the lower side is dominant according to the value of the wiring resistance of the current supply paths. By switching the current supply paths with the passage of time, a gradient of the voltage drop can be averaged more effectively without causing the gradient of the voltage drop of either of the current supply paths operating dominantly for the pixel portion.

As an index of switching timing of the current supply paths in an active matrix display device, around 60 frames of display screens are written per second generally so as to prevent flickers of the display screen from being recognized by a user. When switching the current supply paths, change in the voltage distribution can be seen as if the display screen is updated, thus it might be recognized as a flicker by a user when the number of switchings is small. Accordingly, ON/OFF of the current supply path is desirably switched once or more at least within the one frame period as shown in FIG. 1B. Larger number of switchings will prevent flickers from being recognized, which improves the display quality.

In FIG. 1B, ON/OFF timing of the first current supply path 102 and the second current supply path 103 are provided alternately, however, there may be an overlapped period in which both of them are ON or OFF.

Figure 3A:
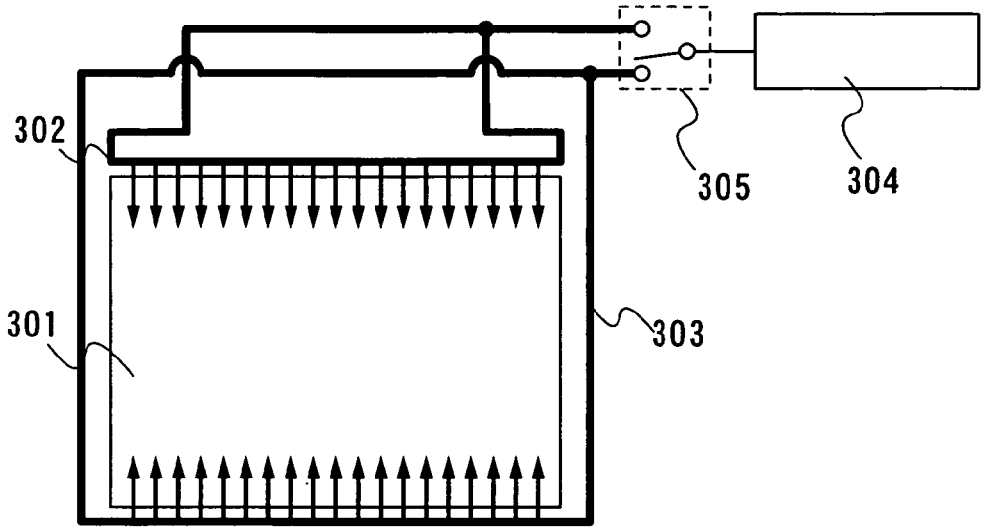
FIGS. 3A-3B illustrate diagrams showing one embodiment of the invention.
Figure 3B:
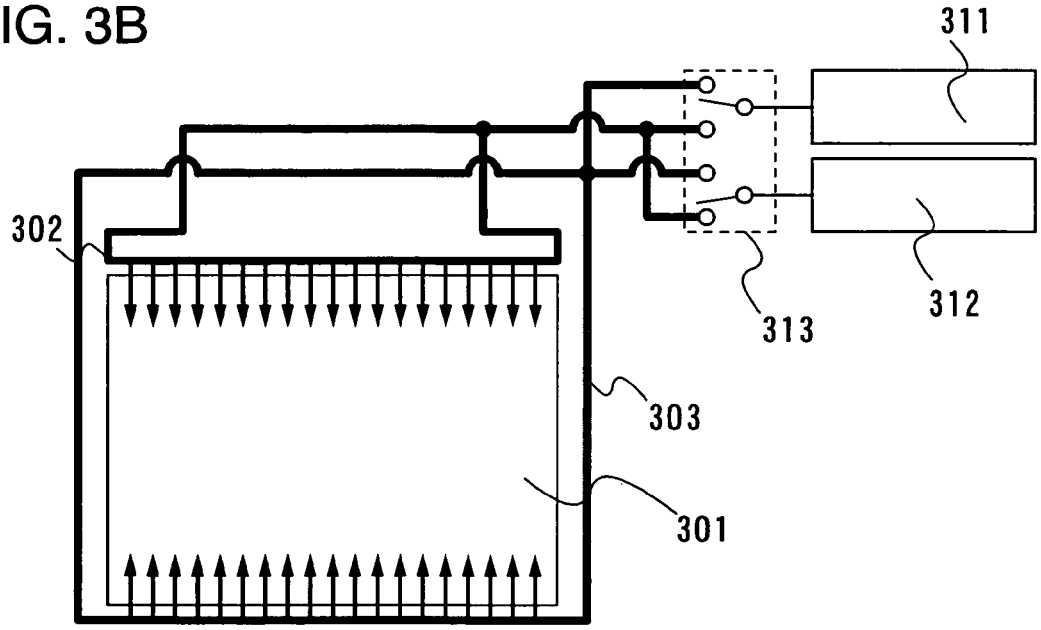

FIG. 3A illustrates a power supply outside of the display device and the like. When switching between a first current supply path 302 and a second current supply path 303 for the pixel portion 301, the single drive power supply 304 may be provided, and the connection/disconnection with the current supply path may be switched using a switch 305. Alternatively, as shown in FIG. 3B, multiple drive power supplies 311 and 312 may be provided, and the connection/disconnection with the respective current supply paths may be switched using a switch 313.

Embodiment 1

Figure 2A:
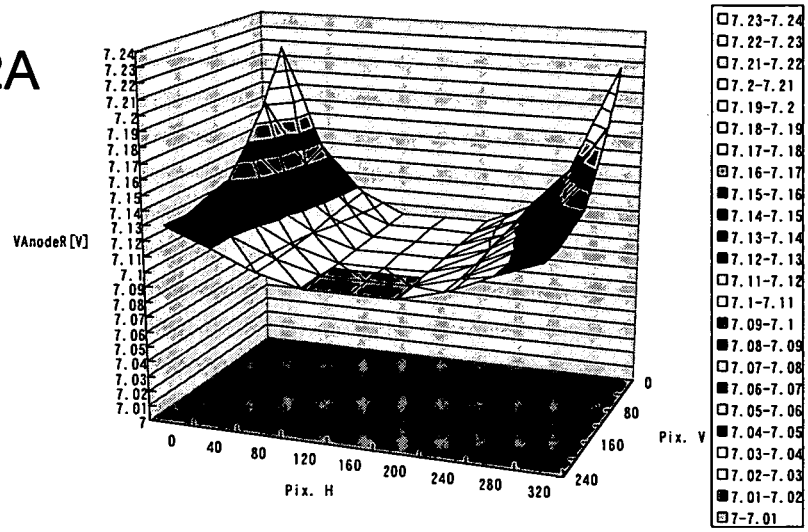
FIGS. 2A-2C illustrate diagrams showing simulation results with regard to the voltage drop in the pixel portion.
Figure 2B:
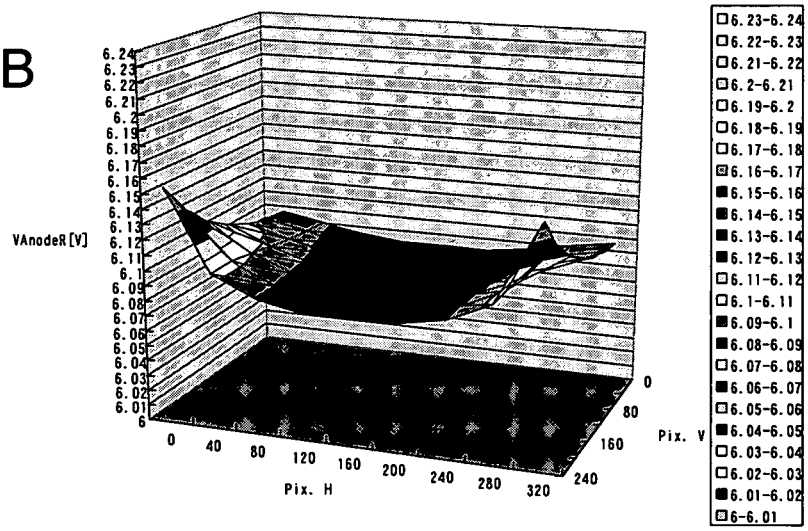
Figure 2C:
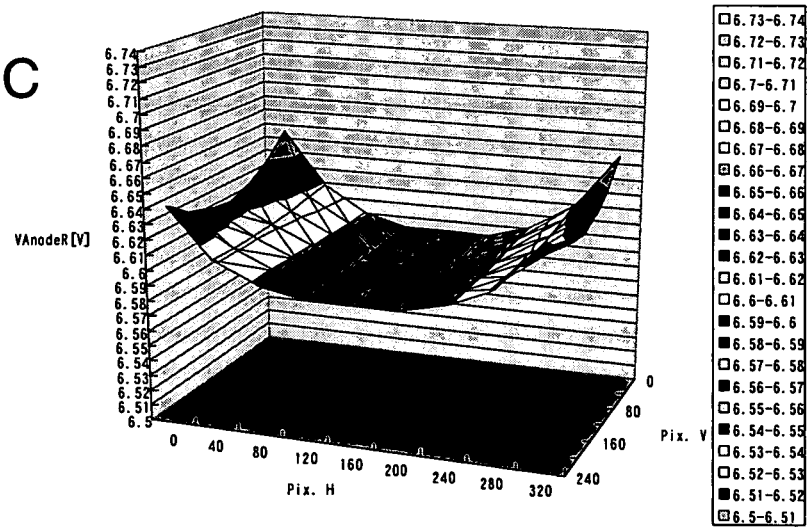

FIGS. 2A to 2C illustrate the simulation results in accordance with the embodiment mode of the invention. FIGS. 2A to 2C each shows the voltage drop of an Anode potential in the case where the whole pixel portion (assumed here: 320×240 pixels (QVGA)) emits light. The back side corresponds to the upper end portion of the display screen while the front side corresponds to the lower end thereof. FIG. 2A shows voltage distribution during the period in which a current is supplied from the first current supply path. FIG. 2B shows voltage distribution during the period in which a current is supplied from the second current supply path. FIG. 2C shows voltage distribution in the case of averaging both of them.

In FIG. 2A, a potential difference of around 0.13 V is generated between the upper right and upper left portions of the display screen having the smallest voltage drop and the central lower end of the display screen having the largest voltage drop. In addition, a gradient is present over the whole range. As is conventional, even in the case where currents are supplied from both of the upper and lower sides of the pixel portion, the current supply path from the upper side of the pixel portion becomes dominant due to the resistance of the lead wirings, therefore, the current supply path from the lower side of the pixel portion does not function as the current supply path sufficiently, thus the voltage distribution similar to FIG. 2A appears.

In FIG. 2B, a potential difference of around 0.08 V is generated between the lower right and upper left portions of the display screen having the smallest voltage drop and the central upper end of the display screen having the largest voltage drop. The voltage gradient across the whole display screen is flatter as compared to FIG. 2A, however, effect of the voltage drop due to the peripheral lead portion is significant, thus the potential as a whole is smaller than FIG. 2A by around 1 V.

FIG. 2C illustrates the case where the first current supply path and the second current supply path are switched with the passage of time to supply a current to the pixel portion, both of which are averaged. The potential difference between the upper right and left portions of the display screen having the smallest voltage drop and the central portion of the display screen having the smallest voltage drop is around 0.08 V, the difference of which is smaller as compared to FIG. 2A. In addition, the gradient on the display screen has a relatively larger flat region.

As described above, the invention makes it possible to further flatten the voltage distribution of the pixel portion, and decrease the change in the VGS of the driving TFT accordingly, which will lead to the smaller luminance distribution on the display screen. In addition, according to the structure of the invention in which different current supply paths connected to the pixel portion are switched with the passage of time, each of the current supply paths can be used independently. Therefore, a gradient of the voltage drop can be averaged without the current value and voltage drop in one of the current supply paths having an effect on the other. The effect of the voltage drop becomes larger in accordance with the increased power consumption, therefore, the invention significantly contributes to the improvement in display quality of the high-resolution active matrix display device having a large display screen.

What is claimed is:

1. A display device comprising:

a pixel portion comprising a plurality of current supply lines and a plurality of pixels arranged in matrix, each of a first pixel and a second pixel in a first column among the plurality of pixels comprising a first EL element and a first TFT, wherein one of a source and a drain of the first TFT is directly connected to a first current supply line among the plurality of current supply lines and the other of the source and the drain of the first TFT is directly connected to the first EL element, each of a third pixel and a fourth pixel in a second column among the plurality of pixels comprising a second EL element and a second TFT, wherein one of a source and a drain of the second TFT is directly connected to a second current supply line among the plurality of current supply lines and the other of the source and the drain of the second TFT is directly connected to the second EL element;

multiple current supply paths for supplying a current from an FPC connecting terminal to the pixel portion, the multiple current supply paths being each directly connected to a different portion of each of the first current supply line and the second current supply line; and a switch for selecting at least one of the multiple current supply paths to supply the current to the pixel portion, wherein the pixel portion is configured to display an image by controlling a light emission state of each of the first pixel, the second pixel, the third pixel and the fourth pixel, wherein the multiple current supply paths are electrically connected to a same power supply through the switch such that a same voltage is applied to the multiple current supply paths, and wherein the multiple current supply paths and the switch are arranged outside the pixel portion.

2. A display device comprising:

a pixel portion comprising a first current supply line, a second current supply line and a first pixel, a second pixel, a third pixel and a fourth pixel arranged in matrix, each of the first pixel and the second pixel in a first column comprising a first EL element and a first TFT, each of the third pixel and the fourth pixel in a second column comprising a second EL element and a second TFT, wherein one of a source and a drain of the first TFT is directly connected to the first current supply line and the other of the source and the drain of the first TFT is directly connected to the first EL element and wherein one of a source and a drain of the second TFT is directly connected to the second current supply line and the other of the source and the drain of the second TFT is directly connected to the second EL element;

a first current supply path for supplying a current from an FPC connecting terminal to the pixel portion, the first current supply path being directly connected to one end of the first current supply line and one end of the second current supply line;

a second current supply path for supplying the current from the FPC connecting terminal to the pixel portion, the second current supply path being directly connected to the other end of the first current supply line and the other end of the second current supply line; and a switch for selecting at least one of the first current supply path and the second current supply path to supply the current to the pixel portion, wherein the pixel portion is configured to display an image by controlling a light emission state of each of the first pixel, the second pixel, the third pixel and the fourth pixel, wherein the first current supply path and the second current supply path are electrically connected to a same power supply through the switch such that a same voltage is applied to the first current supply path and the second current supply path, and wherein the first current supply path, the second current supply path and the switch are arranged outside the pixel portion.

3. A display device comprising:

a pixel portion comprising a plurality of current supply lines and a plurality of pixels arranged in matrix, each of a first pixel and a second pixel in a first column among the plurality of pixels comprising a first EL element and a first TFT, wherein one of a source and a drain of the first TFT is directly connected to a first current supply line among the plurality of current supply lines and the other of the source and the drain of the first TFT is directly connected to the first EL element, each of a third pixel and a fourth pixel in a second column among the plurality of pixels comprising a second EL element and a second TFT, wherein one of a source and a drain of the second TFT is directly connected to a second current supply line among the plurality of current supply lines and the other of the source and the drain of the second TFT is directly connected to the second EL element;

multiple current supply paths for supplying a current from an FPC connecting terminal to the pixel portion, the multiple current supply paths being each directly connected to a different portion of each of the first current supply line and the second current supply line; and a switch for selecting at least one of the multiple current supply paths to supply the current to the pixel portion and switching the multiple current supply paths with the passage of time, wherein the pixel portion is configured to display an image by controlling a light emission state of each of the first pixel, the second pixel, the third pixel and the fourth pixel, wherein the multiple current supply paths are electrically connected to a same power supply through the switch such that a same voltage is applied to the multiple current supply paths, and wherein the multiple current supply paths and the switch are arranged outside the pixel portion.

4. A display device comprising:

a pixel portion comprising a first current supply line, a second current supply line and a first pixel, a second pixel, a third pixel and a fourth pixel arranged in matrix, each of the first pixel and the second pixel in a first column comprising a first EL element and a first TFT, each of the third pixel and the fourth pixel in a second column comprising a second EL element and a second TFT, wherein one of a source and a drain of the first TFT is directly connected to the first current supply line and the other of the source and the drain of the first TFT is directly connected to the first EL element and wherein one of a source and a drain of the second TFT is directly connected to the second current supply line and the other of the source and the drain of the second TFT is directly connected to the second EL element;

a first current supply path for supplying a current from an FPC connecting terminal to the pixel portion, the first current supply path being directly connected to one end of the first current supply line and one end of the second current supply line;

a second current supply path for supplying the current from the FPC connecting terminal to the pixel portion, the second current supply path being directly connected to the other end of the first current supply line and the other end of the second current supply line; and a switch for selecting one of the first current supply path and the second current supply path to supply the current to the pixel portion and switching the first current supply path and the second current supply path with the passage of time, wherein the pixel portion is configured to display an image by controlling a light emission state of each of the first pixel, the second pixel, the third pixel and the fourth pixel, wherein the first current supply path and the second current supply path are electrically connected to a same power supply through the switch such that a same voltage is applied to the first current supply path and the second current supply path, and wherein the first current supply path, the second current supply path and the switch are arranged outside the pixel portion.

5. A driving method of a display device comprising a pixel portion comprising a plurality of current supply lines and a plurality of pixels arranged in matrix, each of a first pixel and a second pixel in a first column among the plurality of pixels comprising a first EL element and a first TFT, wherein one of a source and a drain of the first TFT is directly connected to a first current supply line among the plurality of current supply lines and the other of the source and the drain of the first TFT is directly connected to the first EL element, each of a third pixel and a fourth pixel in a second column among the plurality of pixels comprising a second EL element and a second TFT, wherein one of a source and a drain of the second TFT is directly connected to a second current supply line among the plurality of current supply lines and the other of the source and the drain of the second TFT is directly connected to the second EL element; a switch; and multiple current supply paths for supplying a current from an FPC connecting terminal to the pixel portion, wherein the multiple current supply paths are each directly connected to a different portion of the current supply line, wherein the multiple current supply paths are electrically connected to a same power supply through the switch such that a same voltage is applied to the multiple current supply paths and wherein the multiple current supply paths and the switch are arranged outside the pixel portion, comprising the steps of:

supplying the current to the pixel portion using a current supply path selected among the multiple current supply paths; and switching the selected current supply path with the passage of time by the switch.

6. The driving method of a display device according to claim 5, wherein the switching of the current supply path is desirably performed in the cycle of once or more within one frame period.

7. A driving method of a display device comprising a pixel portion comprising a first current supply line, a second current supply line and a first pixel, a second pixel, a third pixel and a fourth pixel arranged in matrix, each of the first pixel and the second pixel in a first column comprising a first EL element and a first TFT, each of the third pixel and the fourth pixel in a second column comprising a second EL element and a second TFT, wherein one of a source and a drain of the first TFT is directly connected to the first current supply line and the other of the source and the drain of the first TFT is directly connected to the first EL element and wherein one of a source and a drain of the second TFT is directly connected to the second current supply line and the other of the source and the drain of the second TFT is directly connected to the second EL element; a switch; a first current supply path for supplying a current from an FPC connecting terminal to the pixel portion; and a second current supply path for supplying the current from the FPC connecting terminal to the pixel portion, wherein the pixel portion is configured to display an image by controlling a light emission state of each of the first pixel, the second pixel, the third pixel and the fourth pixel, wherein the first current supply path is directly connected to one end of the first current supply line and one end of the second current supply line, and the second current supply path is directly connected to the other end of the first current supply line and the other end of the second current supply line, wherein the first current supply path and the second current supply path are electrically connected to a same power supply through the switch such that a same voltage is applied to the first current supply path and the second current supply path and wherein the first current supply path, the second current supply path and the switch are arranged outside the pixel portion, comprising the steps of:

supplying the current to the pixel portion using a current supply path selected between the first current supply path and the second current supply path; and switching the selected current supply path with the passage of time by the switch.

8. The driving method of a display device according to claim 7, wherein the switching of the current supply path is performed in the cycle of once or more within one frame period.

* * * * *